US005484958A

United States Patent [19]

Ogawa

[11] Patent Number: 5,484,958

[45] Date of Patent: Jan. 16, 1996

[54] MUSICAL INSTRUMENT AND A METHOD OF APPLYING A LOW IMPEDANCE AMPLIFER TO A MUSCIAL INSTRUMENT

[76] Inventor: Hiroshi Ogawa, 6-2, Iwakura-muramatsu-cho, Sakyo-ku, Kyoto-shi, Kyoto 606, Japan

[21] Appl. No.: 309,454

[22] Filed: Sep. 22, 1994

Related U.S. Application Data

[62] Division of Ser. No. 96,836, Jul. 26, 1993, abandoned, which is a continuation of Ser. No. 631,674, Dec. 20, 1990, abandoned.

[51] Int. Cl.[6] ..... G10H 3/18

[52] U.S. Cl. ..... 84/731; 84/DIG. 24

[58] Field of Search ..... 84/721, 730–732, 84/735–742, DIG. 24

[56] References Cited

U.S. PATENT DOCUMENTS

| | | | |
|---|---|---|---|
| 3,382,446 | 5/1968 | Carre | 330/186 |
| 3,601,712 | 8/1971 | Elazar | 330/277 X |
| 3,624,264 | 11/1971 | Lazarus | 84/730 |
| 3,663,735 | 5/1972 | Evans | 84/721 |
| 3,711,617 | 1/1973 | Evans | 84/DIG. 24 |
| 4,374,363 | 2/1983 | Previti | 330/264 X |
| 4,379,996 | 4/1983 | Weber | 330/188 |
| 4,501,186 | 2/1985 | Ikuma | 84/DIG. 24 |
| 4,819,537 | 4/1989 | Hayes et al. | 84/736 |
| 5,007,324 | 4/1991 | DeMichele | 84/741 |

*Primary Examiner*—Stanley J. Witkowski
*Attorney, Agent, or Firm*—Wenderoth, Lind & Ponack

[57] ABSTRACT

A low impedance amplifier include a matching circuit composed of passive elements and active elements for matching the input impedance of the amplifier to a piezoelectric and/or pyroelectric signal generated in a low impedance structure; and an amplifying circuit composed of passive elements and active elements for amplifying the input signal simultaneously as the impedance matching. The amplifier is capable of electrically amplifying low impedance electrical phenomena. Accordingly, the amplifier permits accurate detection of structural abnormality in various structures. As one application example of the above amplifier to structural abnormality detection, a method of applying the amplifier of the present invention to a musical instrument enables any existing musical instrument to be used as an electric instrument without changing its original sound quality and provides the possibility of realizing a new instrument.

6 Claims, 11 Drawing Sheets

MUSICAL INSTRUMENT AND A METHOD OF APPLYING A LOW IMPEDANCE AMPLIFER TO A MUSCIAL INSTRUMENT

This application is a division of now abandoned application Ser. No. 08/096,836, filed Jul. 26, 1993, which is in turn a continuation of now abandoned application Ser. No. 07/631,674, filed Dec. 20, 1990.

BACKGROUND OF THE INVENTION

1. Field of the Invention

The present invention relates to a low impedance amplifier for use in detecting the structural abnormality of substances by detecting piezoelectricity and/or pyroelectricity generated in a structure composed of electrically conducting crystalline or non-crystalline substances with no band gap or a band gap of not higher than 0.008 eV.

2. Description of the Prior Art

The inventor invented "a method of detecting structural abnormality of substances" (disclosed in the Japanese Patent Laid-Open Patent Publication No. SHO62-259050). The basic circuit, shown in the FIGS. 6-1, 6-2, 7-1, 7-2, 8 and 9 attached to the above patent application, generates electrical phenomena such as piezoelectricity and/or pyroelectricity that would occur in a structure composed of electrically conducting crystalline or non-crystalline substances with no band gap. The method according to this invention comprises extracting the electrical phenomena through leads each connected to each of at least a pair of terminals provided directly on the simple and basic structure, and monitoring and measuring the thus extracted piezoelectricity and/or pyroelectricity, thereby accurately locating and identifying the extent of seriousness of the stress-caused structural abnormality of the structure.

As an invention related to the above disclosure, the inventor also invented "a detecting element" (disclosed in the Japanese Laid-Open Patent Publication No. SHO63-157024). This element, made of a metal (any metal, inorganic or organic), electrically detects at least one of piezoelectricity, pyroelectricity and inverse piezoelectricity phenomena occurring in the metal. In the above two pending applications, the inventor discloses the fact that piezoelectricity and/or pyroelectricity phenomena occur in electrically conducting metals and inorganic or non-organic substances with no band gap regardless of whether they are crystalline or non-crystalline, in substances composed of more than one of these metals and/or substances, and in electrically conducting metals (inorganic or organic) with a very small (narrow) band gap. The inventor also discloses the method of measuring these electrical phenomena for detecting the dynamic change macroscopically in these substances or in a structure composed of these substances, and microscopically in molecules and atoms constituting these substances.

The low impedance amplifier of the present invention is used as a low impedance amplifier including an impedance converter (with a built-in preamplifier) comprised in a circuit system, as shown in the block diagram of the structural abnormality detecting circuit in FIG. 3 attached to the Laid-Open Publication No. SHO62-259050, and in FIG. 2 attached to the Laid-Open Publication No. SHO63-157024. The amplifier of the present invention is a preamplifier necessary for electrical amplification of the electric phenomena which cannot be attained by the conventional amplifier with high impedance on the input side.

Namely, piezoelectricity and/or pyroelectricity occurring in a structure composed of the above-mentioned substances is a signal of a low impedance of the order of $1\times10^{-9}$ to $1\times10^{4}$ ohms. Such a low impedance signal cannot be amplified electrically by any amplifier other than a low impedance amplifier. The conventional amplifier is designed for high impedance and not for low impedance. Therefore, it cannot be used as a "low impedance amplifier" in the circuit of detecting the structural abnormality resulting from spontaneous polarization of a low impedance structure.

More specifically, the conventional method of measuring distortion of a substance or structure caused by an external force application involves, as a sensor to distortion, a piezoelectric pickup which utilizes electrical spontaneous polarization, or a strain gage which utilizes current change in a resistor. Such a sensor is attached to a substance or structure to measure the distortion by using an amplifier suitable to the sensor.

However, the piezoelectric pickup provides a high impedance. The strain gage measures distortion by sending a signal for the current change in the resistor to an amplifier through a bridge circuit.

As mentioned earlier, amplifiers for a high impedance pickup or strain gage already exist. But an amplifier for low impedance piezoelectricity or pyroelectricity does not.

As disclosed in the above-mentioned publications, electrically conducting crystalline or non-crystalline metal substances (inorganic or organic) with no band gap or with a very small (narrow) band gap generate piezoelectricity and/or pyroelectricity electrically when they are subjected to an external force. Any of the conventional amplifiers for a piezoelectric pickup or a strain gage is not suitable as an amplifier for such electrical phenomena; some provide high input impedance and the others are designed for amplification of the potential difference caused directly by current.

In other words, electromotive force by such electrical phenomena as piezoelectricity and pyroelectricity which occur in the above-mentioned low impedance substances is very small as a signal source. It is impossible to amplify this electromotive force by the conventional high impedance amplifier.

SUMMARY OF THE INVENTION

In view of the above, it is an object of the present invention to provide a low impedance amplifier capable of electrically amplifying the above-mentioned low impedance electric phenomena.

Another object of the invention is to provide a method of applying the low impedance amplifier to a musical instrument to extract electrical signals from the instrument, as an example of amplifying electrical signals generated in a low impedance structure.

The former object of the invention is achieved by an amplifier for use in detecting the structural abnormality of substances by detecting piezoelectricity and/or pyroelectricity generated in a structure composed of an electrically conducting crystalline or non-crystalline substance with no band gap or a band gap of not higher than 0.008 eV, comprising a matching circuit composed of passive elements and active elements for matching the input impedance of the amplifier to a piezoelectric or pyroelectric signal generated in the low impedance structure, and an amplifying circuit composed of passive elements and active elements for amplifying the input signal simultaneously as the impedance matching.

The latter object of the present invention, that is, a method of applying the low impedance amplifier to a musical instrument is achieved by connecting leads directly, through terminal electrodes as necessary, to a structure or a supporting members to be a sound source of the musical instrument, extracting piezoelectricity and/or pyroelectricity generated in the structure, and amplifying the electrical signal by the low impedance amplifier through an impedance converter as necessary.

The source of electromotive force in the present invention, that is, a substance subject to measurement by the low impedance amplifier, is an electrically conducting crystalline or non-crystalline metal with no band gap in view of the band theory or with a 0.008 eV or smaller (more narrow) band gap. It is inorganic or organic metal whose electrical resistance is an between $1\times10^{-9}$ and $1\times10^{-1}$ ohms/cm. Piezoelectricity and/or pyroelectricity occur in such a substance. (For details, refer to the above-mentioned publications.)

As is obvious from the above description, the low impedance referred to in the present invention indicates an impedance of the order of $1\times10^{-9}$ and $1\times10^{4}$ ohms with a frequency bandwidth of DC to about 1,000 MHz in general. The performance of the low impedance amplifier can be expanded to about 50 GHz depending on the substance to be measured and the external force working on the substance.

The amplifier of the present invention utilizes a low impedance electrical phenomenon in a substance as an input signal.

Basically, the amplifier of the present invention comprises a matching circuit composed of passive elements (such as resistors, capacitors, coils and transformers) and active elements (such as transistors) for matching the input impedance of the amplifier to the electrical signal of an electrical phenomenon in the low impedance substance, and an amplifying circuit composed of passive elements and active elements for amplifying the input signal simultaneously as the impedance matching. As is disclosed in detail in the above-mentioned laid-open publication No. SHO62-259050, this amplifier provides a high electrical potential. The publication also discloses a simple method of extracting the electrical signal through a pair of electrical terminals and shows a flow sheet summarizing the method.

The high electrical potential is detected by a low impedance circuit (which does not use a shield box as shown in FIGS. 9 and 10). In the circuit for detecting a high electrical potential as shown in FIG. 9, one end of a lead wire which is about 100 mm long is connected to a metal M (a 25 mm by 900 mm long carbon steel pipe), and the lead wire is provided with terminals $T_1'$ and $T_2'$. The circuit detects high potential discharging phenomenon occurring in the metal M as potential difference due to the characteristic resistance value (between $T_1'$ and $T_2'$) of the lead wire. In the circuit shown in FIG. 10, several turns of a vinyl-insulated wire is wound around a metal M (a 25 mm dia. by 900 mm long carbon steel pipe) in an electrically insulated manner to provide a terminal $T_1'$. Another terminal $T_2'$ is provided on a lead connected to the end portion of the metal M away from the terminal $T_1'$. The circuit detects high potential discharging phenomenon occurring in the metal M as a potential difference between $T_1'$ and $T_2'$.

FIGS. 3 and 4 show different impedance converters or transformers used as a passive element for connecting the above electrical phenomenon to the input of the amplifier. These impedance converters or transformers are used as a matching device.

According to the present invention, the circuit following the impedance converter (not shown) does not comprise such a circuit that uses the output of the converter directly or as shown in FIGS. 1 and 2 but includes a circuit (not shown) capable of indicating the electrical phenomenon occurring, without a power supply, in a low impedance substance or a structure composed of low impedance substances.

Therefore, various circuit constructions are possible for the amplifier. It may consist of a basic circuit shown in FIG. 1 or 2. Alternatively, the circuit of FIG. 1 or 2 may be used as a difference amplifier for the initial stage. The basic circuits shown in FIGS. 1 and 2 are given only as typical examples.

According to the present invention, the low impedance amplifier is applicable to a low impedance structure which is a sound source like that of a musical instrument. In this application, the low impedance structure is, as is clear from the subsequent explanation, a sound source of any existing metal-made musical instrument (such as a string instrument, brass instrument, percussion instrument and piano).

The application will now be described for a string of a guitar as an example. When a steel string of an electric guitar is touched or flipped by a finger or a pick, it vibrates. According to the theory disclosed by the inventor in the above-mentioned publications, as the string vibrates, it changes in the dynamic state, resulting in structural abnormality in the molecules and atoms, which in turn generates piezoelectricity in the string. If the piezoelectricity is taken out through a lead and amplified by the low impedance amplifier of the present invention through an impedance converter, the sound of the musical scale corresponding to the vibration frequency of the string can be obtained through a speaker. The conventional electric guitar uses pickups to convert the vibration of a string to an electrical signal, or in other words, to convert the mechanical vibration of a string to an electrical signal indirectly. In contrast, the electric guitar to which the present invention is applied extracts an electrical signal generated by a string directly and amplifies it. Accordingly, it does not require pickups. Thus, according to the present invention, it is possible to realize an electric guitar which extracts sound quite differently from the conventional method.

The application is not limited to the electric guitar. The amplifier of the present invention is also applicable effectively to other instruments that use metal strings. A piano is an example. Conventionally, when a piano is played solo in a large concert hall, it is harder for a listener to hear the original sound as the listening position is remoter from the piano. If the low impedance amplifier of the present invention is applied to the piano, it is possible to take out piezoelectric signals generated in vibrating strings, directly for amplification. As a result, piano sound of a uniform quality can be heard at any listening position of the hall. Meanwhile, the piano performance by a good player is recorded conventionally through microphones. In such conventional recording method, the propagation of the sound pressure vibration energy differs greatly depending on the air condition in the recording room. This makes faithful recording difficult or virtually impossible. One of the most prominent feature of the present invention lies here. When the low impedance amplifier of the present invention is applied to the piano, even delicate keyboard touches are recorded faithfully.

The above feature is the very object of the present invention. That is, by applying the amplifier of the present invention, it is possible to take out electrical signals directly and electrically from any kind of metal substance.

In a popular or rock music performance that involves many electric instruments, it is necessary to harmonize the sound volume of the piano with those of other electric instruments or to compensate for the insufficient volume of the raw piano sound. For this purpose, the piano sound is conventionally collected by microphones and amplified by an amplifier. If the piezoelectricity generated in the strings is taken out directly and amplified in the method described above for an electric guitar, microphones are not necessary and troublesome microphone settings and other adjustment work are eliminated. In addition, according to the present invention, the oscillation wave of strings is amplified directly. Therefore, unlike the sound through microphones, the amplified sound coming out of speakers has the same quality as the original piano sound, though depending the speaker performance.

To extract electrical signals (normally, a piezoelectric signal) from each metal string of the electric guitar or piano, a lead is connected to a point insusceptible to the string vibration, outside the support on each end of the string. Alternatively, it may be connected directly to the support if the support is made of metal. If the lead is connected to each point outside the support, piezoelectricity is generated in the actually vibrating portion of the string between the supports. Since the piezoelectricity is generated as an electrical signal, it is transmitted to the area outside the supports. This is mechanical electrical energy. Namely, a mechanical quantity is converted to an electrical quantity. As a result, the piezoelectric signal is extracted through the lead.

When the lead is connected to each metal support, the mechanical vibration of the string is also transmitted to the supports, so that the supports vibrate with the string. Consequently, piezoelectricity generated in the string flows to the supports while piezoelectricity is generated in the supports as well. The vibration frequency of each support is basically equal to that of the string, and the piezoelectricity in the supports is also equal to that in the string. Therefore, the sound obtained from a speaker by amplifying the piezoelectricity in the supports is completely identical in quality with the original sound from the sound source.

One of the preferable methods includes indirectly vibrating the actually vibrating portion of the string or metal of other types in the magnetic static field, which as a result, causes amplification of electrical signal (generated in the metal substance). The magnetic static field force is determined by the conditions and the physical properties of the metal substance. The metal substance may be inorganic metal substance or organic metal substance irrespective of a band gap.

The sound we hear from a piano or guitar being played is composed of not only the sound direct from the sound source like strings but the resonance sound of the frame and various parts which support the sound source and of wooden or metal body which houses parts. The strings pick up the resonance sound and vibrate sympathetically with it. As a result, we hear the sound from the entire instrument as the natural sound of the instrument.

If the instrument, or all parts of the instrument such as supports, frames, framework, rim, nuts, frets and bridges, which are described later, are made of ceramic, the instrument will generate an ideal sound that does not contain any disturbing noise. In this case, it is only necessary to coincide the mechanical condition with the electrical condition of the amplifier.

The invention has been described in relation to metal strings. The present invention is also applicable to harps, vibraphones, marimbas, triangles and other instruments if metal strings are contained in nylon strings. The invention is applicable even to woodwind instruments if the resonance members are partly made of metal.

Thus, the present invention is applicable not only to string instruments and keyboard instruments but to every kind of existing instrument including woodwind instruments, brasses and percussion instruments. Furthermore, by applying the invention, it is possible to realize an utterly new instrument that could generate a new sound which any existing instrument cannot.

The low impedance amplifier may be incorporated in a musical instrument together with a power supply suitable to the instrument. A low impedance signal amplifying circuit containing the low impedance amplifier may be housed in an amplifier of the final stage. To obtain sufficiently large volume of sound from speakers in a large concert hall, it is necessary to treat electrical signals amplified by the low impedance amplifier in a P.A. system normally used for the performance of electric instruments.

DETAILED DESCRIPTION OF THE INVENTION

Some embodiments of the low impedance amplifier of the present invention are described in detail in the following.

Figure 1:
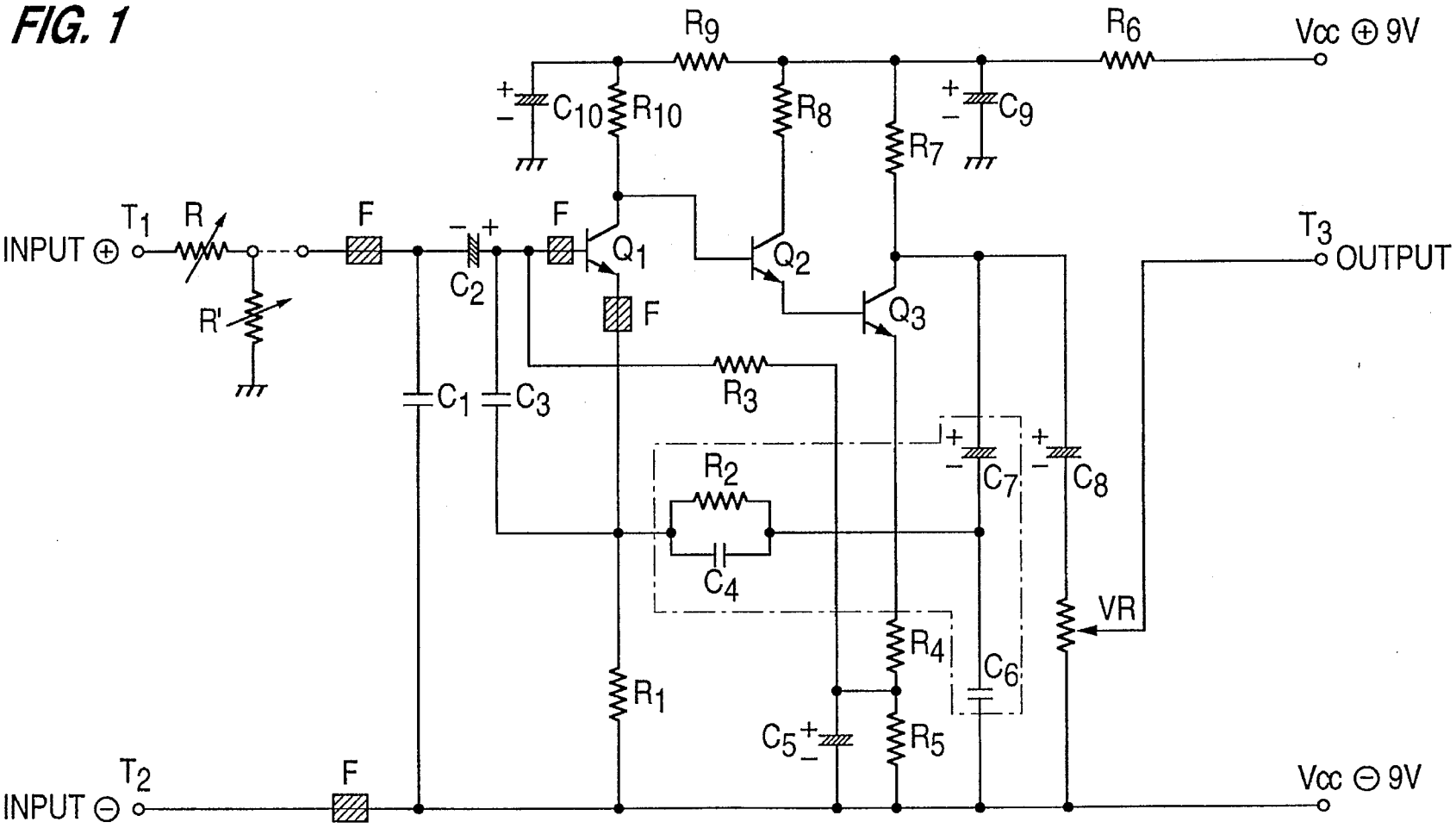
FIG. 1 is a circuit diagram of an embodiment of the amplifier of the present invention.

Referring to FIG. 1, the circuit is operable for a frequency between about 10 Hz and 20 KHz unless the constants of the passive elements (such as resistors and capacitors) of the circuit are changed. If the constants are changed, the circuit is operable even for a frequency between 1 Hz and 50 KHz, and therefore permits recording in a tape recorder.

Piezoelectric and/or pyroelectric signals generated in a low impedance substance are connected to the input terminals $T_1$ ⊕ and $T_2$ ⊖. Amplified output is taken out through the terminals $T_3$ and Vcc ⊖. A power supply (DC 9 V, not shown) is connected between the terminals Vcc ⊕ and Vcc ⊖.

The input side resistors R and R' adjust the input impedance according to the low impedance signal source of the substance to be measured. The resistors may be of either fixed or variable detachable type (In the circuit shown, they are of variable type). The ferrite cores F eliminate high frequency noise that has entered the circuit. The capacitor $C_1$ provides the same function.

The electrolytic capacitor $C_2$ is provided in the circuit for a.c. coupling. It determines the bandwidth and impedance of the input frequency on the input side. Namely, by selecting appropriate values for the capacitor $C_2$ and resistors $R_1$, $R_4$, $R_5$ and $R_7$ through $R_{10}$, it is possible to determine the input impedance of the circuit.

NPN transistors $Q_1$, $Q_2$ and $Q_3$ designed for low noise and high amplification factor are used to amplify the input signal power. The transistors $Q_2$ and $Q_3$ provide a Darlington connection to permit substantial amplification of the output of the transistor $Q_1$. The electrolytic capacitor $C_{10}$ stabilizes the voltage of the amplifying circuit of the transistor $Q_1$.

Enclosed by chain line is a circuit for recording the amplified output in a tape recorder as required. It compensates for standard reproduction at various tape speeds. The circuit determines the frequency characteristic for the recording.

Figure 2:
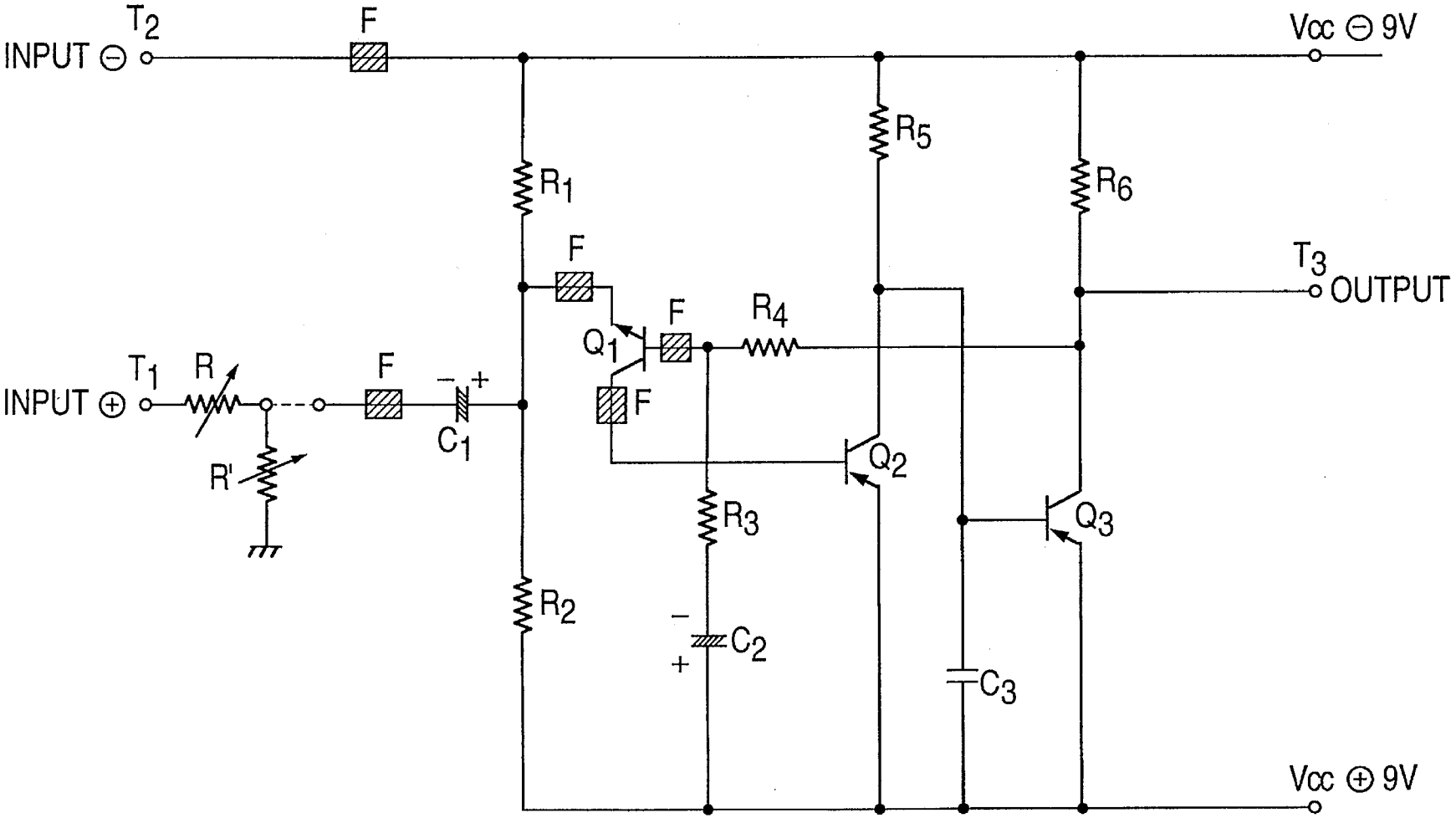
FIG. 2 is a circuit diagram of another embodiment of the amplifier of the present invention.

Referring to FIG. 2, the circuit is operable for a wide frequency band ranging from about 1 Hz to 1 MHz.

Similar to the circuit in FIG. 1, electrical signals are connected to the input terminals $T_1$ ⊕ and $T_2$ ⊖, and amplified output is taken out through the terminals $T_3$ and Vcc ⊖. A power supply (DC 9 to 25 V, not shown) is connected between the terminals Vcc ⊕ and Vcc ⊖.

Other features of the circuit in FIG. 2 are basically identical with those of the circuit of FIG. 1. Namely, the input side resistors R and R' adjust the input impedance according to the electric signal source of the substance to be measured. The resistors are of either fixed or variable detachable type (In the circuit, they are of variable type). The ferrite cores F eliminate high frequency noise that has entered the circuit.

The electrolytic capacitor $C_1$ is provided in the circuit for a.c. coupling. It determines the bandwidth and impedance of the input frequency on the input side. By selecting appropriate values for the capacitor $C_1$ and resistors $R_1$, $R_2$, $R_5$ and $R_6$, it is possible to determine the input impedance of the circuit.

NPN transistor $Q_1$ and PNP transistors $Q_2$ and $Q_3$ designed for low noise and high amplification factor are used to amplify the input signal power. The transistor $Q_1$ is electrically different from the transistors $Q_2$ and $Q_3$. By selecting appropriate values for the resistor $R_3$ and capacitors $C_2$ and $C_3$, it is possible to determine the frequency characteristic of the circuit.

The circuits shown in FIGS. 1 and 2 are operated with a DC 9 to 25 V power supply. The power supply may be incorporated in the amplifier or provided outside the amplifier. Needless to say, the voltage of the power supply to be used is not limited to about DC 9 V. It may be varied according to the circuit construction.

In the amplifier (preamplifier) shown in FIG. 1 or 2, a low impedance feeble signal generated in the electromotive force source or the substance to be measured enters the amplifier through the input terminals $T_1$ ⊕ and $T_2$ ⊖. The signal is then matched with the input impedance by the matching circuit and simultaneously amplified by the amplifying circuit. The amplified signal is sent through the output terminals $T_3$ and Vcc ⊖ to an intermediate amplifier of the next stage. Amplifiers for intermediate through final amplification may be composed of any kind of existing amplifying circuit.

According to the present invention, a low impedance feeble signal generated in the substance may be led directly into the amplifier through the input terminals $T_1$ ⊕ and $T_2$ ⊖. In order to match the low impedance feeble signal with the input impedance of the amplifier to detect structural abnormality of the substance, it is preferable to conduct the simultaneous matching and voltage boost passively. Namely, one possible method of obtaining a preferable result is to use a transformer capable of impedance conversion and voltage boost. The transformers shown in FIGS. 3 and 4 meet this requirement.

Figure 3:
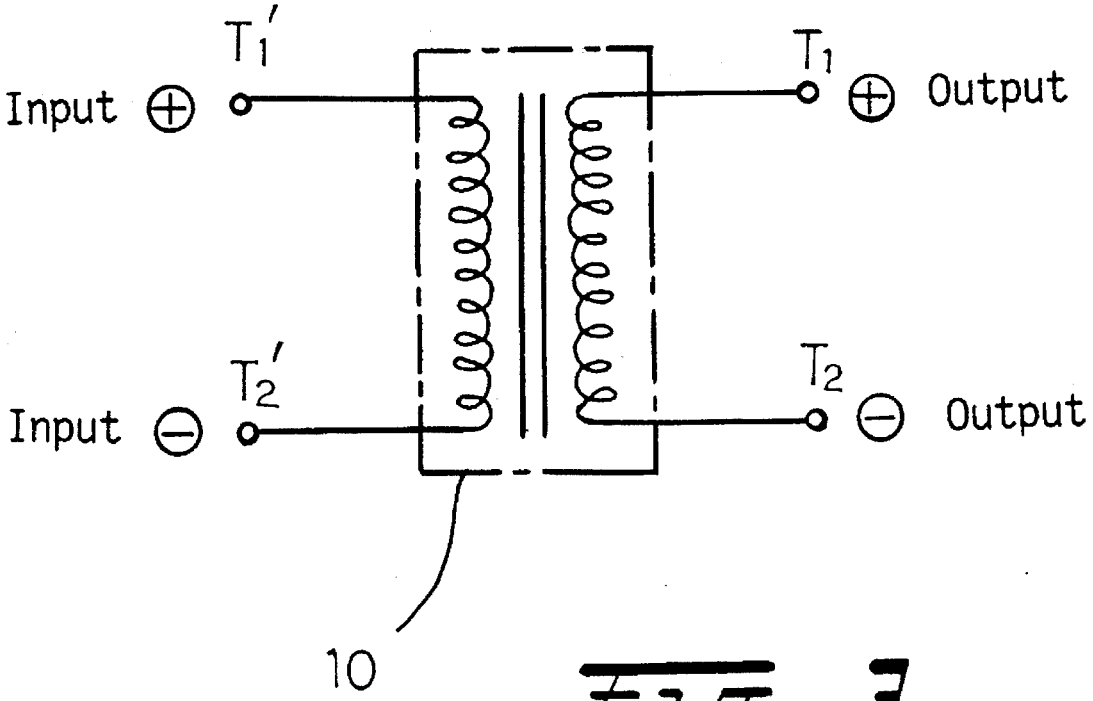
FIGS. 3 and 4 are schematic drawings of transformers used as an impedance converter or matching device connected to the input of the amplifier of the present invention.
Figure 4:
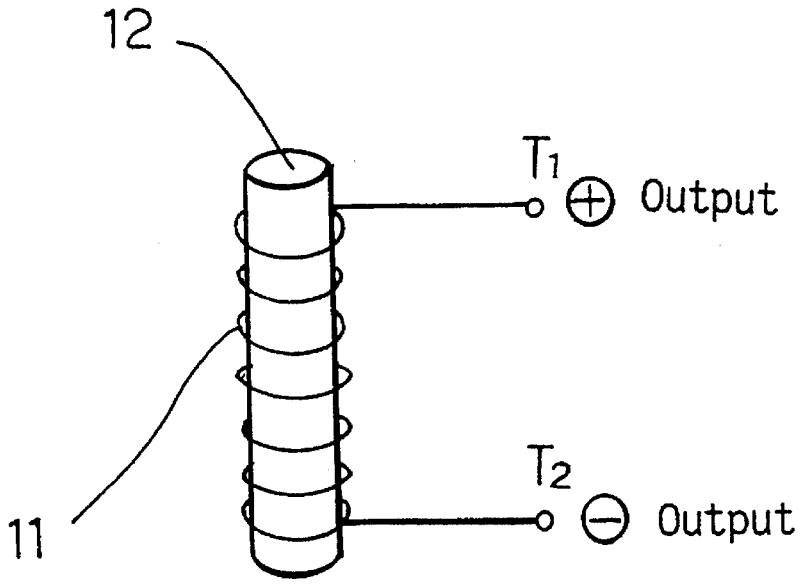

The transformer 10 of FIG. 3 is not limited in the characteristic if the input impedance of the transformer is matched with the impedance on the amplifier side (the output side of the transformer). For example, for a transformer that provides a voltage step-up ratio of about 5 to 40 with a primary winding resistance of $1\times10^{-9}$ to 5 ohms and a secondary winding resistance of 10 to 3,000 ohms, the frequency characteristic is either 0.01 Hz to 20 KHz or 1 Hz to 50 MHz. The transformer shown in FIG. 4 comprises a single winding of wire 11 wound around a subject substance 12 to detect structural abnormality of the substance and to serve as a transformer. The number of turns of the coil is selected so that the impedance of a signal taken out from the substance 12 is matched with the input impedance of the amplifier. The winding wire resistance value is $1\times10^{-9}$ to $1\times10^{4}$ ohms. The frequency characteristic of the winding is determined by the physical property of the substance 12.

Figure 10:
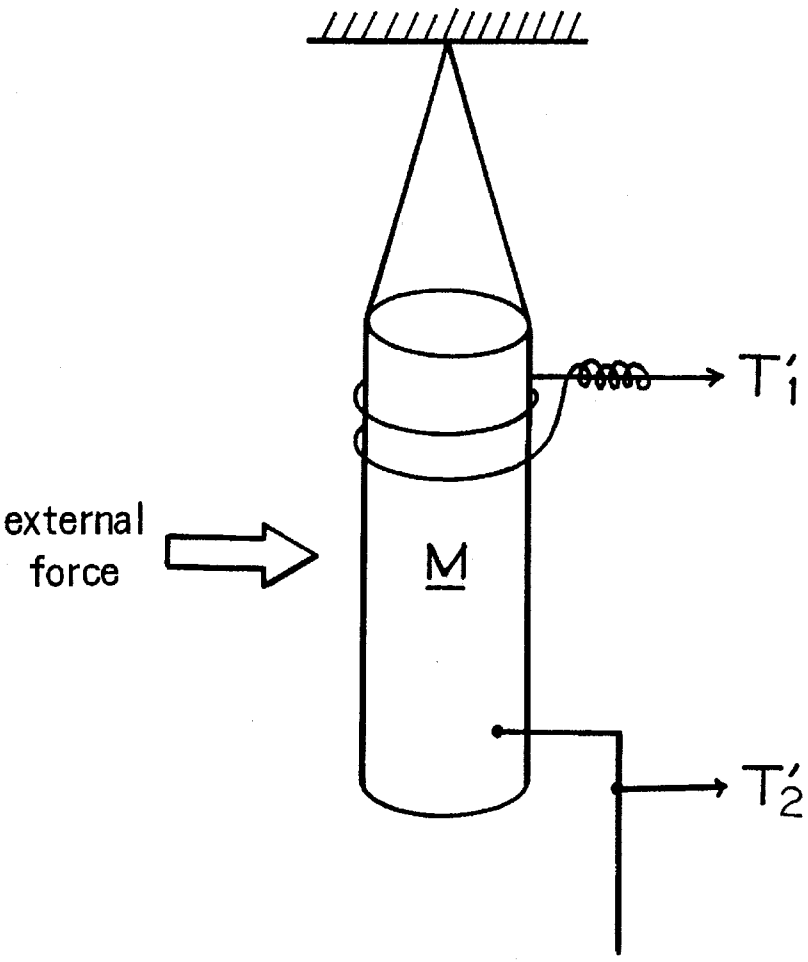
FIGS. 9 and 10 are schematic drawings of low impedance circuits (which do not use a shield box) for extracting high potential electrical discharge phenomenon.
Figure 9:
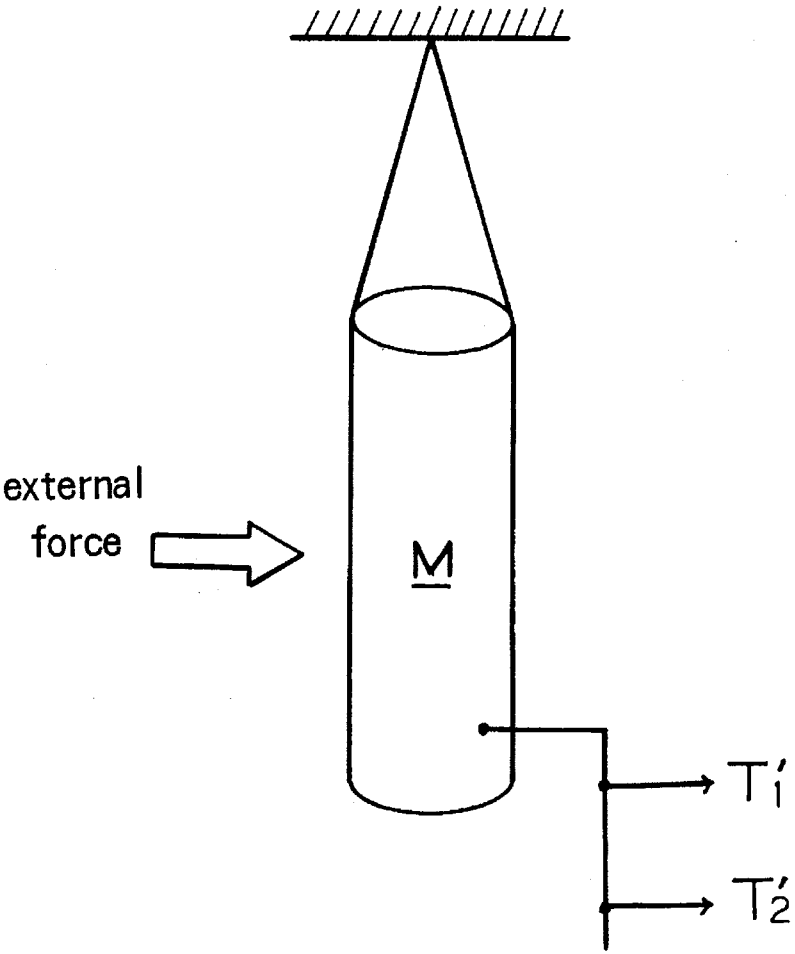

The method of using these transformers is as follows. For the transformer 3 of FIG. 10, the output terminals $T_1$ ⊕ and $T_2$ ⊖ of the transformer 10 are connected respectively to the input terminals $T_1$ ⊕ and $T_2$ ⊖ of the amplifier circuit shown in FIG. 1 or 2, and a low impedance piezoelectric or pyroelectric signal generated in the substance is connected to the input terminals $T_1'$ ⊕ and $T_2'$ ⊖ of the transformer 10. For the transformer of FIG. 4, the output terminals of the single winding of wire 11 $T_1$ ⊕ and $T_2$ ⊖ are connected respectively to the input terminals $T_1$ ⊕ and $T_2$ ⊖ of the amplifier circuit in FIG. 1 or 2.

By using either of these transformers, the input impedance to the amplifier of FIG. 1 or 2 is stabilized. As a result, it is only necessary to match the impedance of the passive elements and active elements of the amplifier circuit with the thus stabilized constant input impedance.

As for the circuitry after intermediate amplification, if the electrically connecting distance between the intermediate amplifier and a subsequent circuit is long, it is preferable to convert an electrical signal to an optical signal at the output of the intermediate amplifier circuit and transmit the optical signal through an optical fiber cable so as to avoid noise influence.

If the amplifier of the present invention is molded in one body together with the intermediate amplifier in rubber or plastic material, it can be used under all weather conditions and therefore can be installed anyplace.

Now, specific application examples of the low impedance amplifier (preamplifier) of the invention will be described further in detail.

As is mentioned above, the amplifier of the present invention is used to amplify electrically the piezoelectricity and/or pyroelectricity phenomena generated in a low impedance substance. For connection to the input of the amplifier, at least one pair of terminals is provided directly on the structure composed of various low impedance substances. Leads connected to these terminals are connected respectively to the input terminals $T_1$ ⊕ and $T_2$ ⊖ of the amplifier circuit.

Figure 5:
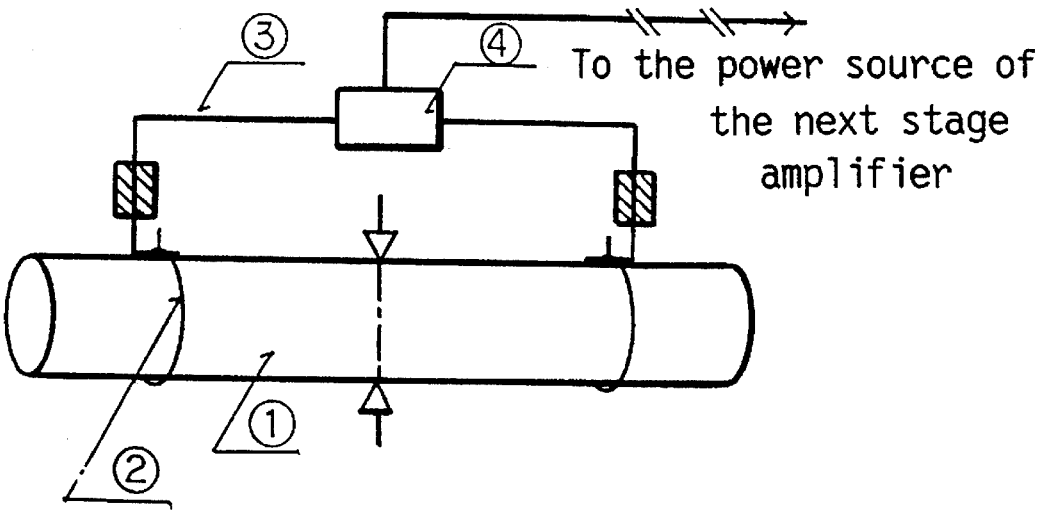
FIGS. 5 through 8 are schematic drawings for explaining specific application methods of the amplifier of the present invention to detect structural abnormality of a substance.
Figure 6:
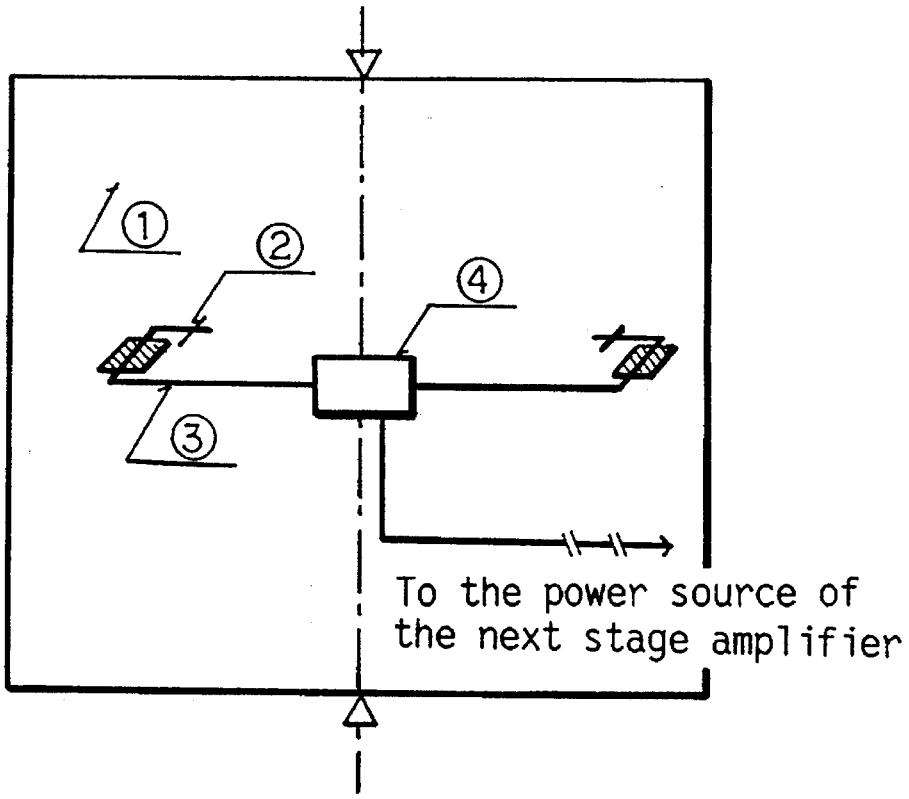
Figure 7:
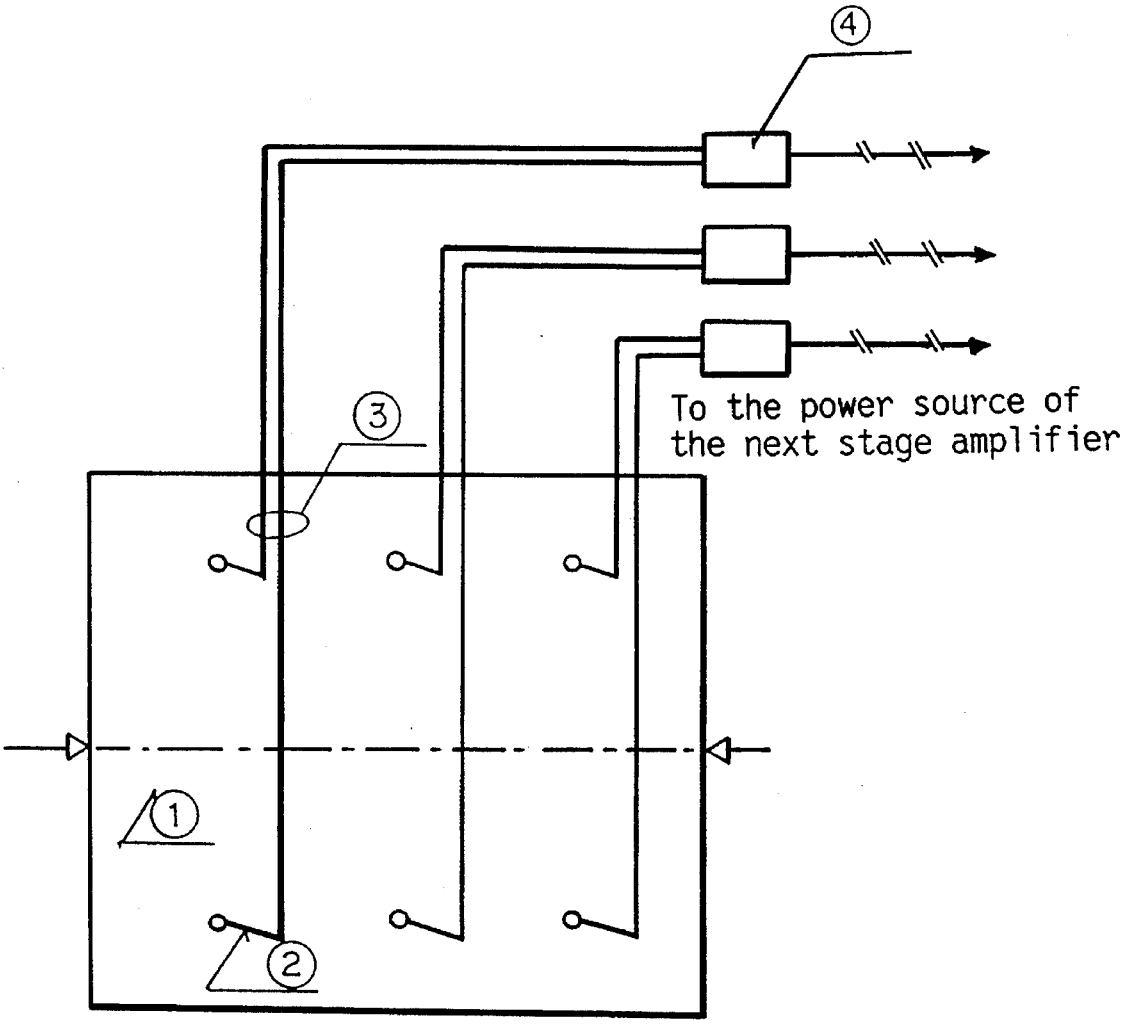
Figure 8:
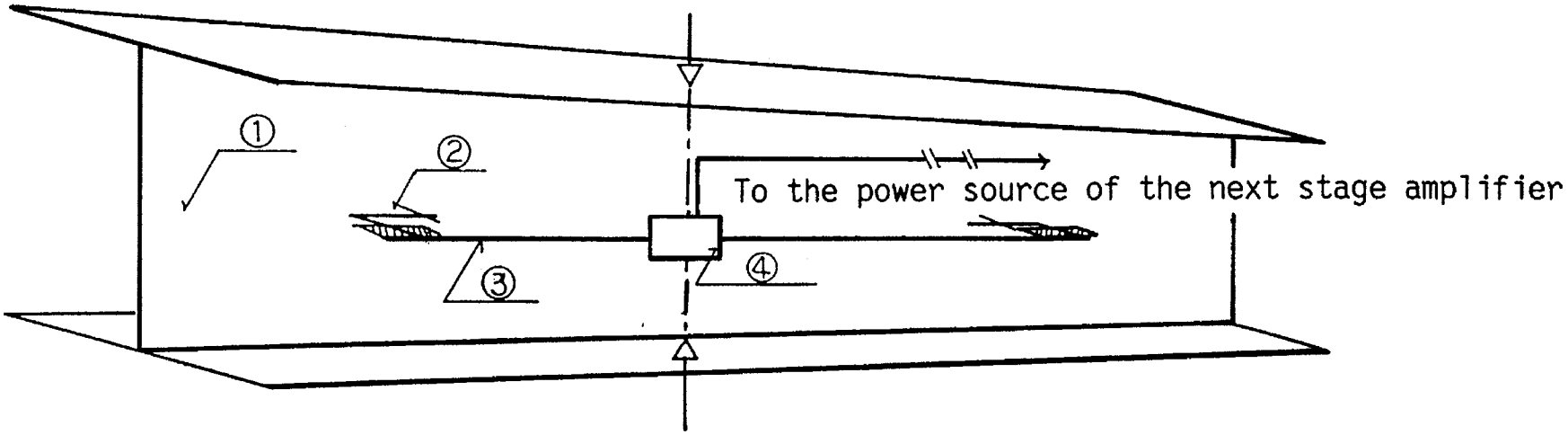

FIGS. 5 through 8 show a part or the whole of a machine, work, vehicle, ship, aircraft, engineering or architectural work, as a structure 1 to be measured. FIG. 5 shows a structural steel pipe constituting an essential part of pressure piping or a structure. FIGS. 6 and 7 show the structural wall of a pressure barrier or pressure vessel, or a steel plate wall of a structure. FIG. 8 shows an essential part of a steel structure. In each of these figures, a chain line indicates the weld, joint or stress-concentrated zone.

Referring to FIGS. 5 through 8, the fixtures 2 or electrical connection serves as terminals for taking out a feeble electric signal generated in the structure 1. To the fixtures 2 are connected wire fittings 3, respectively. The wire fittings 3 not only transmit electrical signals to the amplifier 4 but retain the amplifier 4. Referring to FIG. 7, the fixtures 2 are studs for connecting electrical circuits, and each wire 3 is connected to the amplifier 4 of the present invention. The fixtures 2 may be used as terminals. If separate terminals are provided on the structure, the fixtures 2 may be insulated metals to fix the respective separate terminals to the structure. Each amplifier 4 is not necessarily held by the wire 3. It may be held by other metal parts.

Referring to FIGS. 5, 6 and 8, the shaded part represents a mechanical transmission blocking device (not shown in detail) which prevents the wire 3 from providing the mechanically same displacement as the structure 1 when the wire 3 also serves to hold the amplifier 4.

In the structure of FIG. 6, a resistor with a discretionary resistance may be used as the mechanical transmission blocking device. The use of such a resistor puts the wire 3 in an electrically different state from the structure 1, thus preventing the wire 3 from generating piezoelectric and/or pyroelectric signals under the same condition as the structure 1. This permits discrimination between the electrical phenomenon in the wire 3 and that in the structure 1.

If M, T or A type wire manufactured by Nisshinbo Industries, Inc. of Japan is selectively used, extremely effective electrical and mechanical region cut-off material will be obtained due to the electrical resistance and mechanical characteristic specified for the conductor. Among the above-mentioned types of wires, "A" type wire is the most preferable as a lead wire to be used in the present invention.

As described earlier, for each structure shown in FIGS. 5 through 8, it is preferable to mold the amplifier 4 together with an intermediate amplifier in rubber or plastic material or to arrange them in a special housing box, to provide for all-weather out-door installation. Furthermore, it is the most preferable to construct the chassis and body with ceramic.

As is obvious from FIGS. 5 through 8, the terminals (fixtures or studs) 2 in pairs are fixed on the structure 1 at positions across the chain line. The impedance between the terminals 2 varies depending on the distance between the terminals. However, any desired input impedance can be set by adjusting the values of the impedance adjusting elements (the capacitor $C_2$ and the resistors $R_1$, $R_2$, $R_5$ and $R_7$ through $R_{10}$ in the circuit of FIG. 1; the capacitor $C_1$ and the resistors $R_1$, $R_2$, $R_5$ and $R_6$ in the circuit of FIG. 2; and the resistors R and R' common to the circuits of FIGS. 1 and 2) in the circuit. Therefore, structural abnormality detection is independent of the distance between the terminals 2.

Thus, according to the present invention, the amplifier 4 amplifies electrical signals (piezoelectric and/or pyroelectric signals) generated in the structure 1 subject to an external force and stress, enabling the mechanical state of the structure 1 to be observed electrically. When the chain line represents a weld and if blow holes are present in the weld area, change in the weld strength is detected. When the chain line represents a joint (a joint with another member or a joint between a horizontal member and a vertical member) where stress is concentrated, change in the rigidity of the joint area is detected.

If the terminals and the amplifiers are used in a plurality as required by the system of the structure, it is possible to observe the stress transmission in the entire structure system and to locate structural abnormalities. In other words, it is possible to know the change in the kinds of working stresses generated in the structure.

FIG. 7 shows an example in which a plurality of the terminals are provided on the structure. If the studs 2 as terminals, the wires 3 and the amplifiers 4 are arranged as shown, stress distribution in the structure can be observed. Since the distance across the chain line between the studs 2 in pairs can be selected as desired, as is already mentioned, it is also possible to conduct spectrum analysis of the energy in the structure 1. Accordingly, when the structure 1 contains pierced holes or cracks, it is possible to examine or predict the stress distribution around the holes or the crack propagating direction.

Furthermore, as is described earlier, the impedance converter shown in FIG. 3 or 4 may be combined with the amplifier 4.

Methods of applying the low impedance amplifier of the present invention to the structure of a machine, building, engineering work or transportation equipment have been described. Now, methods of applying the invention to musical instruments are described below.

Figure 11:
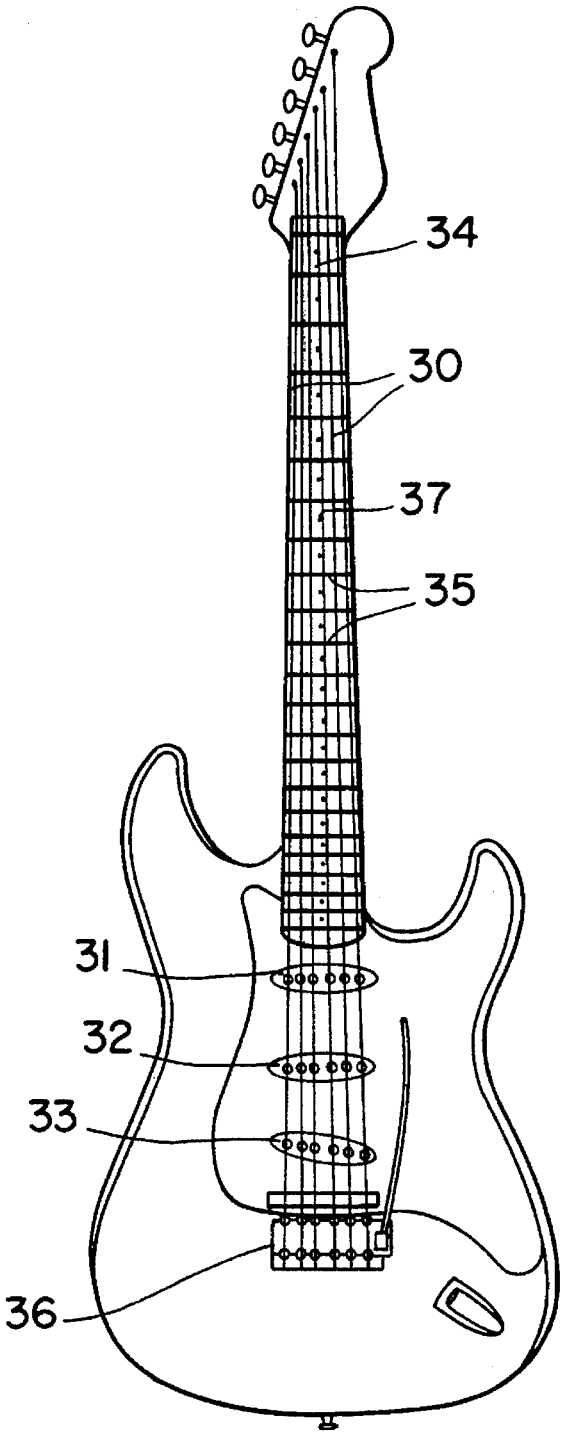
FIG. 11 is a front view of a typical electric guitar.
Figure 12:
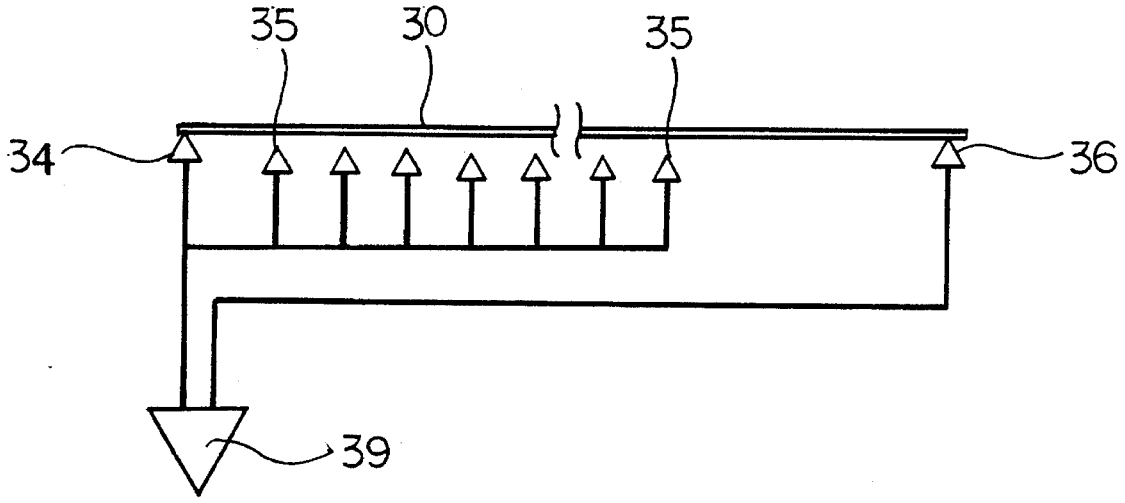
FIG. 12 is an explanatory drawing of the circuit to be used when the amplifier of the present invention is applied to the guitar of FIG. 11.

FIG. 11 is a front view of a typical electric guitar in which three pickups 31, 32 and 33 are provided to convert the vibration of strings 30 to electrical signals. To apply the amplifier of the present invention to this guitar, appropriate leads (not shown) are connected, instead of the pickups, to the nut 34, each fret 35 and the bridge 36. Considering the appearance, the wiring is laid behind the external panels of the guitar. For an electric guitar, the nut 34 is sometimes made of hard resin or ivory although the frets 35 and the bridge 36 are normally made of metal. In this case, terminal electrodes may be connected respectively to strings at positions outside the nut 34. The wiring diagram is schematically shown in FIG. 12. As is understood from this diagram, when a string 30 is vibrated with the bridge 36 and a discretionary fret 35 on the finger board 37 as fulcrums, piezoelectricity is generated in the string 30 due to the vibrating external force. The piezoelectric signal is extracted through the terminal electrode lead connected to the nut 34 or the string at a position outside the nut 34 and through the lead connected to the bridge 36, and then amplified by the low impedance amplifier 39 through an impedance converter if necessary. The sound ultimately obtained through a speaker has a natural vibration frequency which depends on the length of the string 30 between the fret and bridge 36 and on the thickness of the string. The quality of the sound thus obtained is superior to that obtained by any conventional method utilized pickups 31 through 33.

Thus, a guitar does not change in the appearance if the present invention is applied. The only change required is to connect leads to the guitar instead of pickups. While the conventional indirect sound pickup method takes out sound locally and unevenly with respect to the vibration of strings, the method according to the present invention takes out sound directly as an electrical phenomenon from the entire actually vibrating portion of the string, so that physically ideal sound can be obtained. This is true not only for guitars but also for pianos, harps and other string instruments as well as machinery. If the present invention is applied to a guitar in particular, the guitar does not require pickups, thus reducing the shape restriction. As a result, it may be possible to realize a completely new shape of a guitar.

Figure 13:
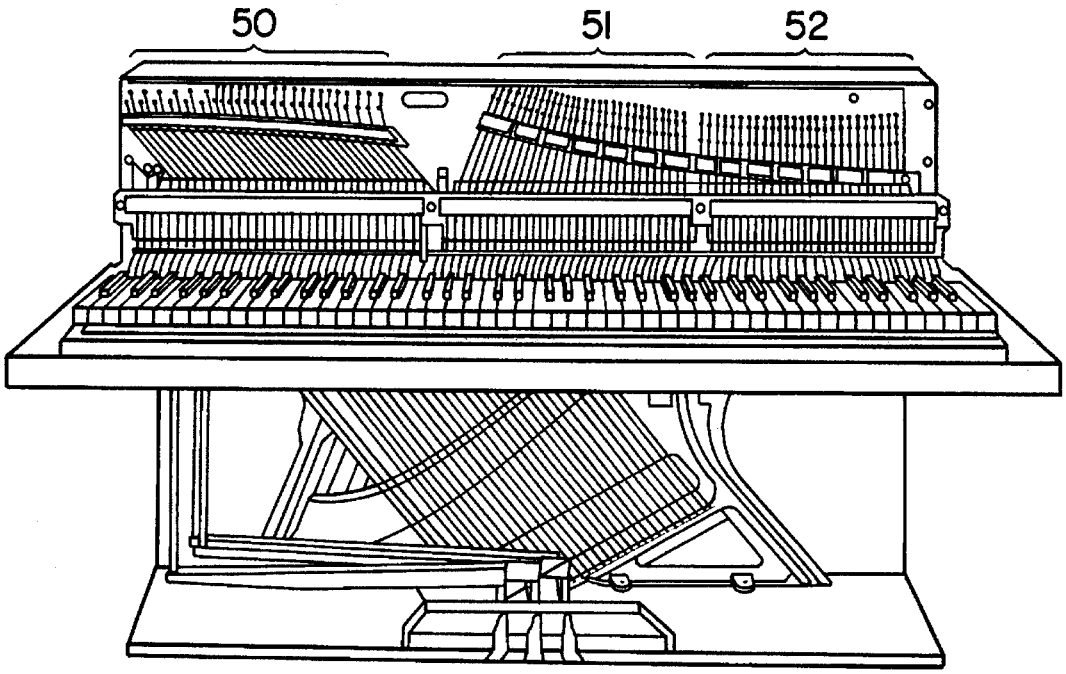
FIG. 13 is a partially broken front view of a typical upright piano.
Figure 14:
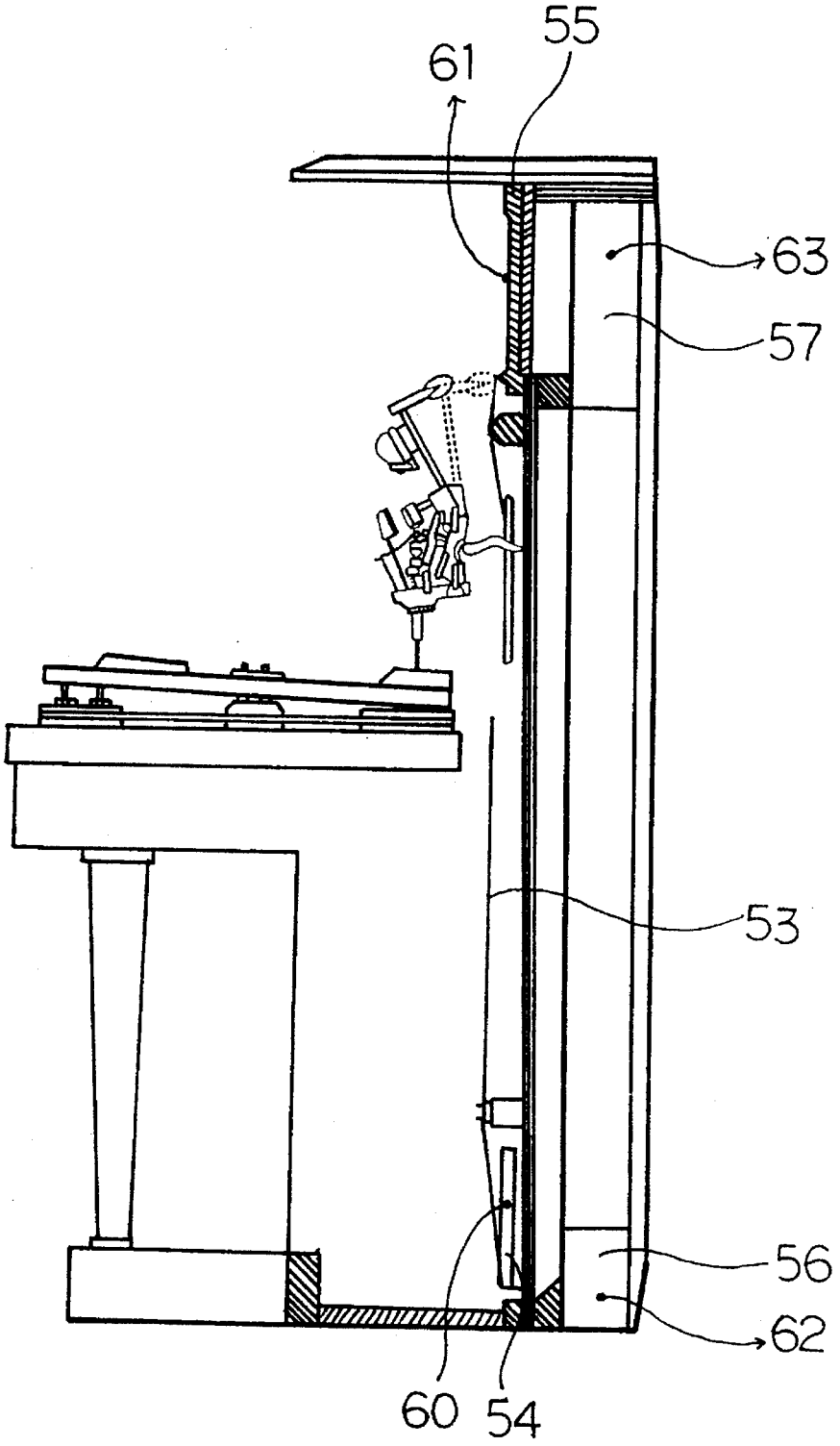
FIG. 14 is a partially broken side view of the piano of FIG. 13 for explaining an example of the application of the amplifier of the present invention to the piano.

Now, the method of applying the present invention to a piano will be described. FIG. 13 is a front view of an upright piano. To apply the invention, a pair of leads may be connected to each string as in the case of a guitar. Since a piano contains numerous strings, the strings may be divided into three groups (bass group 50, middle group 51 and treble group 52) as shown in FIG. 13 to take out signal sound from each group. Referring to FIG. 14, if leads are connected to each string, the leads 60 and 61 are connected respectively to the metal plates 54 and 55 which support both ends of each string 53. If strings are divided into groups, the leads 62 and 63 are connected to the bottom beam 56 and the rear beam 57, respectively, which serve as the frame of the piano. In this embodiment, the invention is applied to an upright piano. Needless to say, the invention is also applicable to a grand piano.

The application method of the invention is basically the same for both guitars and pianos. As is already described, all parts of the instrument such as nut, frets, bridge, plate, frame, bottom beam and rear beam may be made of ceramic. Electrical signals may be taken out from each part, or otherwise they may be taken out by division or collectively. The electrical signals thus taken out are subjected to linear amplification, mixing amplification or mean amplification. Any of these methods may be selected according to the price requirement. That is, it is possible to select the desired balance between the price and the performance by choosing an appropriate method.

Figure 15:
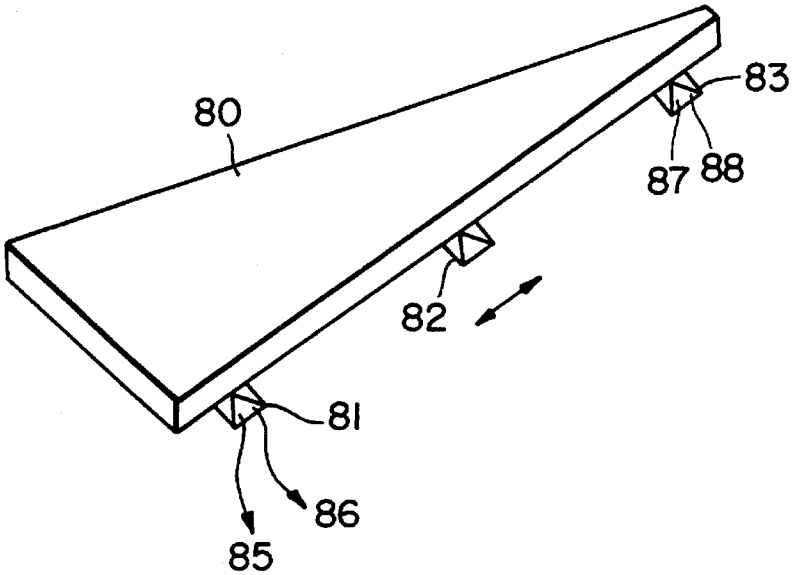
FIG. 15 is a schematic perspective view of a new instrument realized by applying the amplifier of the present invention.

Thus, the present invention is applicable not only to electric guitars and pianos but to harps, triangles, cymbals, vibraphones and marimbas. Application of the present invention permits other existing musical instruments to be used as electric instruments. An explanation for such other musical instruments is omitted here to avoid duplicated description. As is already mentioned, by applying the present invention, it is possible to produce a completely new musical instrument which does not exist now. An example of a new instrument is shown in FIG. 15. In the instrument shown, the sound source 80 is a string, pipe, plate or the like. It is tapered in shape and rectangular in section. It may be horizontal, vertical or inclined. The sound source 80 is held at both ends by ceramic or metal-made stationary supports 81 and 83 and at a point between the stationary supports 81 and 83 by a ceramic or plastic mobile support 82. The mobile support 82 is not necessarily used. The supports 81 and 83 provide independent channels with leads 85 and 86 extending from the left channel and leads 87 and 88 extending from the right channel, for instance. Thus, electrical signals are amplified by the two channels using the a delay, frequency modulation or mixing technique as required. In this example, sound with the frequency of the sound source 80 between the supports 81 and 82 is obtained from the left channel, and sound with the frequency between the supports 83 and 82 from the right channel. In the case where the sound source 80 is supported at three points, an external force is applied to either one or two points to play the instrument, that is, one in the left channel region (between the supports 81 and 82) and the other in the right channel region (between the supports 81 and 82). In the case the support 82 is not used, an external force is applied to one point. If the support 82 is moved in either direction or the application of an external force is varied, or if an external force is applied to various points when the support 82 is not used, withdrawing sound may be obtained from one channel and approaching sound from the other channel, or more unique and interesting sounds may be obtained from each channel, due to the independence of each channel and various amplification techniques mentioned above. Naturally, different sounds can be obtained from these channels by varying the material and/or shape of the sound source 80. Each channel need not always be in line contact with the sound source 80. It may have face contact.

As described above in detail, the low impedance amplifier of the present invention comprises a matching circuit composed of passive elements and active elements for matching the input impedance of the amplifier to piezoelectric and/or pyroelectric signals generated in a low impedance structure, and an amplifying circuit composed of passive elements and active elements for amplifying the input signal simultaneously as impedance matching. Therefore, the low impedance amplifier of the present invention, capable of electrically amplifying the electrical phenomenon in a low impedance structure, is suitable for use in detecting the structural abnormality of substances by detecting piezoelectricity and/or pyroelectricity generated in a structure composed of electrically conducting crystalline or non-crystalline substances with no band gap or a band gap of not higher than 0.008 eV.

Therefore, if the amplifier of the present invention is applied to detect a structural abnormality in a structure or structure system composed of the above-mentioned substances, of a large plant, building, equipment attached to the large plant or building, engineering work, bridge, internal engine, vehicle, ship, aircraft and industrial machine that often generate piezoelectricity and/or pyroelectricity; an underground pipe subject to traffic load and earth pressure; and a reinforcing bar and a steel frame in concrete, it is possible to prevent destruction of the structure or structure system caused by structural abnormality that may occur in it under mechanical or thermodynamic influence. The present invention is also applicable to destructive or non-destructive test on various objects ranging from models of the above-mentioned structure or structural system to small fishing hooks.

Furthermore, the present invention can be used in measuring the resonance of a part or component of any kind of structure including an industrial machine, and the stress displacement distribution, oscillation distribution, section modulus, buckling coefficient of a pressure measuring diaphragm made of special metal or stainless steel. It can be used in studying any kind of physical conditions including the design condition of a hanging bell provided in Japanese temples.

Thus, the amplifier of the present invention plays an extremely important role and has an extremely wide range of applications.

The inventor has named the structural abnormality detection method by the present invention "Mechanical Electrical Direct reading Method (abbreviated as M.E.D.M).

The low impedance amplifier of the present invention is applicable to any existing musical instrument, and by applying the present invention, it possible to play various musical instruments as electric instruments. In addition, unlike the sound obtained through microphones which includes every conditional loss energy, the sound obtained by the method of the present invention has virtually the same quality as the original sound of the instrument. Furthermore, the present invention has a potential to realize a new musical instrument which is completely different from any existing instrument. The present invention is also useful in producing background sound or announcement sound for the general public in a hall like a plaza, through a bell, chime, musical box or above-mentioned new instrument.

What is claimed is:

1. A method of applying a low impedance amplifier to a musical instrument, comprising electrically connecting lead wires to a structure made of an electrically conducting crystalline or non-crystalline substance having no band gap or a band gap of not higher than 0.008 eV which is a sound source of a musical instrument and has a low impedance matched to the low impedance amplifier; taking out through the lead wires a piezoelectric signal generated by the structure due to its own vibration in response to a music playing operation applied thereto; and amplifying the outputted generated signal by the low impedance amplifier which is supplied with the signal through the lead wires.

2. A method of applying the amplifier to a musical instrument as claimed in claim 1, wherein said structure is a string of a piano and wherein leads are connected respectively to part of metal elements supporting the ends of the string.

3. A method of applying the amplifier to a musical instrument as claimed in claim 1, wherein said structure is a string of an electric guitar and wherein leads are connected respectively to a nut and a bridge that support both ends of the string and to each fret on a neck of the guitar.

4. A musical instrument comprising a sound source structure made of an electrically conducting crystalline or non-crystalline substance having no band gap or a band gap of not higher than 0.008 eV and having a low impedance, a pair of lead connections electrically connected to opposite ends of an entire actually vibrating portion of said sound source structure for outputting piezoelectric signals generated at said vibrating portion according to the vibration due to a musical playing operation applied thereto, a low input impedance amplifier connected to said pair of lead connections for amplifying the piezoelectric signals generated at said vibrating portion, and a speaker operated in response to the output of said low input impedance amplifier to emanate sound signals according to the vibration of said vibrating portion.

5. A musical instrument as defined in claim 4, wherein said sound source structure is each of strings of a piano, and wherein said pair of lead connections are respectively connected to a pair of metal plates supporting the ends of each string.

6. A musical instrument as defined in claim 4, wherein said sound source structure is each of strings of an electric guitar, and wherein said pair of lead connections are respectively connected to a nut and a bridge which are in turn electrically connected to the opposite ends of each string, respectively.

* * * * *